US005889811A

United States Patent [19]

Dratner

[11] Patent Number: 5,889,811

[45] Date of Patent: Mar. 30, 1999

[54] ARRANGEMENT FOR TRANSFERRING ELECTRICAL ENERGY FROM A FURNACE TRANSFORMER TO THE ELECTRODES OF A THREE-PHASE ARC FURNACE

[75] Inventor: Christof Dratner, Osnabrück, Germany

[73] Assignee: KM Europa Metal AG, Osnabruck, Germany

[21] Appl. No.: 862,340

[22] Filed: May 23, 1997

[30] Foreign Application Priority Data

May 30, 1996 [DE] Germany ..... 196 21 672.9

[51] Int. Cl.[6] ..... H05B 7/11

[52] U.S. Cl. ..... 373/103; 373/101

[58] Field of Search ..... 373/98, 99, 100, 373/101, 102, 103

[56] References Cited

U.S. PATENT DOCUMENTS

| | | | |
|---|---|---|---|
| 2,908,736 | 10/1959 | Ernst | 373/103 |
| 4,425,658 | 1/1984 | Bretthauer et al. | 373/103 |
| 4,682,341 | 7/1987 | Ehle et al. | 373/99 |

FOREIGN PATENT DOCUMENTS 0 184 140 11/1985 European Pat. Off. .

OTHER PUBLICATIONS

Timm, K. "Reactance Balancing in High–Current Supply Lines For Three–phase Electric Arc Furnaces." Elektrowärne International 49 (Nov. 1991), B4, pp. B201 to B211.

*Primary Examiner*—Teresa Walberg
*Assistant Examiner*—Quang Van
*Attorney, Agent, or Firm*—Kenyon & Kenyon

[57] ABSTRACT

An apparatus for transferring the electrical energy from a furnace transformer to the electrodes of a three-phase arc furnace held by coplanar mast arms. A mast arm for the center current phase is made of aluminum or a material with a similar permeability. The conductor of the center current phase, which is made of at least one high-current tube made of a material with good electrical conductivity, is mounted in insulated fashion in the mast arm and has a smaller geometrical diameter than the conductors for the outer current phases provided by the other two mast arms.

13 Claims, 3 Drawing Sheets

ARRANGEMENT FOR TRANSFERRING ELECTRICAL ENERGY FROM A FURNACE TRANSFORMER TO THE ELECTRODES OF A THREE-PHASE ARC FURNACE

FIELD OF THE INVENTION

The present invention relates to an arrangement for transferring electrical energy from a furnace transformer to the electrodes, held in coplanar mast arms, of a three-phase arc furnace.

BACKGROUND INFORMATION

It is known in the related art to attach a high-current line, consisting of at least one generally water-cooled tube made of copper or another highly conductive material, high up on a center mast arm in order to achieve balance within a high-current system. It is further known, in the field of current-carrying mast arms, to achieve balance by bending the center mast arm at an elevated position, or by additional installation of balancing loops on the mast arms or on the transformer return line, as shown in European Patent No. 0 184 140 and its U.S. counterpart, U.S. Pat. No. 4,682,341, the contents of which are incorporated herein by reference for these teachings. In most of the cases put into practice, however, the center mast arm is bent upward, resulting in a so-called triangulated arrangement with which inductive balancing can be achieved.

Certain serious disadvantages, however, are associated with the triangulated arrangement of the mast arms. One disadvantage is in the high weight of the center mast arm as compared to the weight of the two outer mast arms. A further disadvantage is the increased weight of the lifting mast supporting the center mast arm which results from this approach. This unequal weight distribution results in extremely uneconomical operation of the three-phase arc furnace.

From theoretical considerations, it is also known to make the diameters of the mast arms different sizes (i.e., a modified coplanar arrangement) in order to balance the reactances of the three-phase arc furnaces, as shown in the journal "Elektrowarme International" 49 (November 1991), B4, pp. B201 to B211. Although the use of a form of coplanar current conductors was common in the first decades of use of three-phase arc furnaces, the prior art (as in the version cited in the journal) fails to teach a practical, fully balanced coplanar conductor layout in a three-phase arc furnace system.

SUMMARY OF THE INVENTION

The present invention is directed to the further development of an electric arc furnace that avoids these problems. In particular, it provides an arrangement for transferring electrical energy from a furnace transformer to the electrodes, held by coplanar mast arms, of a three-phase arc furnace, which possesses a markedly lower weight in the center phase as compared with a triangulated arrangement.

The present invention proceeds from the realization of a quantitatively demonstrable fact—a coplanar conductor layout in a three-phase system is fully balanced if the geometrical center radius of the conductor of the center current phase is less than the geometrical center radius of the conductor of the two outer current phases (the term "geometrical center radius" is understood to mean a measurement from a center point of the conductor to an outside surface of the conductor). Building on this knowledge, the conductor of the center current phase is constructed to have a smaller geometrical diameter than that of the conductors for the two outer phases, and is housed in an insulated fashion in a mast arm that is made of aluminum or a material with a similar permeability. Preferably, to achieve a phase reactance of equal magnitude with the coplanar layout, the geometrical diameter of the center conductor is less than the geometrical diameter of the first and the second conductors by approximately a factor of 4. These features lead to optimal inductive balance with a coplanar arrangement of the mast arms, with a low weight (distributed evenly over the three-phases) for the mast arms and the lifting masts associated with them. This makes it possible to use the coplanar conductor layout instead of the usual triangular conductor layout for reactance balancing, even for high furnace power levels. Among the benefits of this approach are a decreased space requirement and, because of the reduced weight, a more uniform and rapid regulation of the reactances of the mast arms.

Insulation of the conductor of the center current phase can be advantageously achieved by spacing the conductor away from the mast arm by a plurality of insulating webs (e.g., three or four insulating webs). Alternatively, an insulating tube can be used in place of the insulated webs for insulation of the conductor.

While the cross section of the insulation-mounted conductor of the center current phase can in principle be configured arbitrarily, such as from a plurality of individual parts, the preferred approach is to provide the conductor of the center current phase as a high-current tube having a circular cross section.

The mast arms may have a cross sectional profile that is coincident with a rectangular profile, including a square profile. Preferably, the rectangular profile is formed by welding together individual sheets of material to form the mast arms.

In a further embodiment of the present invention, if needed, water cooling can be provided for only the conductor of the center current phase. Alternatively, the conductor of the outer current phases, i.e. the mast arms, can be cooled with water or air or can be positively ventilated.

DETAILED DESCRIPTION

Figure 1:
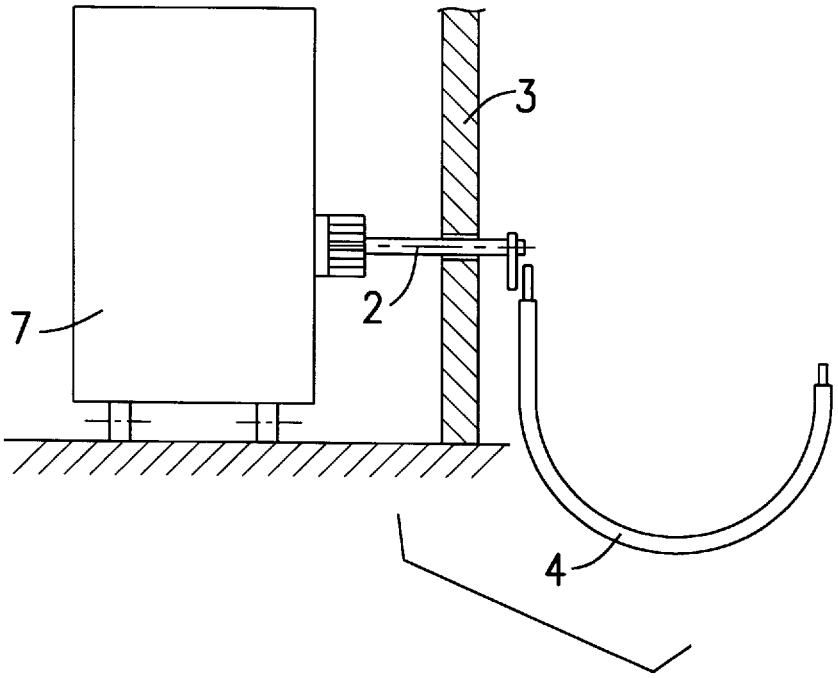
FIG. 1 is a schematic side view of a furnace transformer having a transformer return line and high-current cable.
Figure 2:
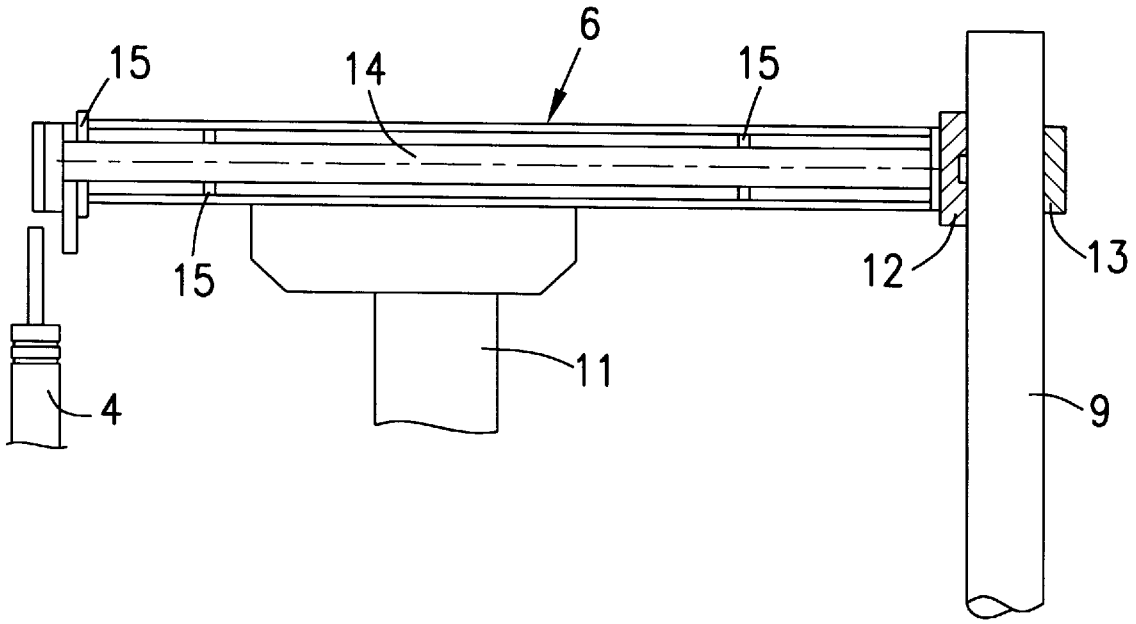
FIG. 2 is an enlarged depiction in vertical longitudinal section of a mast arm having an electrode, lifting mast, and high-current cable.
Figure 3:
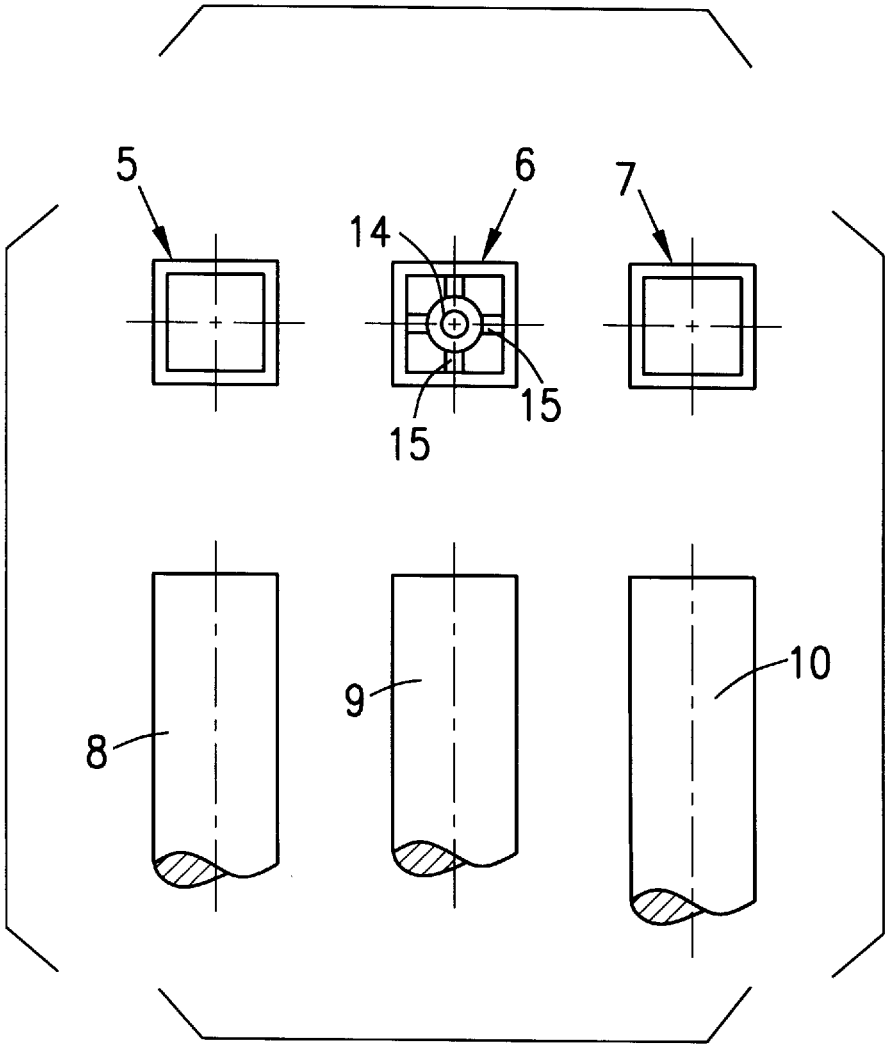
FIG. 3 shows three mast arms, arranged in coplanar fashion, with partially depicted electrodes.

Referring to FIG. 1, a furnace transformer for a three-phase arc furnace (not depicted in further detail) is designated by the numeral 1. Transformer return line 2 passes from the furnace transformer 1 through a wall 3. Connected at the end of transformer return line 2 are three high-current cables 4, installed in a hanging fashion and which, as shown by FIGS. 2 and 3, lead to mast arms 5, 6, and 7. Mast arms 5, 6, and 7 are arranged in a coplanar fashion and each connect to graphite electrodes 8, 9, and 10, respectively.

The mast arms 5, 6, and 7 are each carried by individual lifting masts 11, as shown in FIG. 2, and are made of aluminum and have a square cross section. The mast arms may also be constructed to consist of a cross section coincident with a rectangular profile. Electrodes 8, 9, and 10 are mounted at the ends of the mast arms 5, 6, and 7, respectively, by means of copper contact jaws 12 and clamps 13.

Mast arms 5 and 7, which can be cooled with water or positively ventilated with air, constitute the two conductors for the two outer current phases.

The center mast arm 6, as shown in FIGS. 2 and 3, contains a round high-current tube made of copper, centered within the mast arm 6, as a conductor 14 for the center current phase. The conductor 14 of the center current phase is spaced away from the mast arm 6 by insulating webs 15 to achieve electrical insulation. Instead of the insulated webs, an insulating tube can also be used. Further, the conductor 14 has a geometrical diameter which is smaller by a factor of 4 than the comparable dimension of conductors 5 and 7 of the two outer current phases. Conductor 14 of the center current phase can be cooled with water.

What is claimed is:

1. An apparatus for transferring electrical energy from a furnace transformer to three electrodes of a three-phase arc furnace, the apparatus comprising:

a first mast arm, comprising a first conductor for conducting a first outer current phase;

a second mast arm, comprising a second conductor for conducting a second outer current phase; and a third mast arm located between the first and second mast arms and coplanar therewith, the first, second and third mast arms being made of a material having permeability coefficient that is approximately equal to that of aluminum; and a center conductor contained within the third mast arm for conducting a center current phase, said center conductor comprising at least one high-current tube made of a material having good electrical conductivity that is mounted in an insulated fashion with respect to the third mast arm, said high-current tube having a smaller geometrical diameter than the geometrical diameter of the first and the second conductors.

2. The apparatus as set forth in claim 1, wherein the center conductor for conducting the center current phase is spaced away from the third mast arm in an insulating fashion by a plurality of insulating webs.

3. The apparatus as defined in claim 1, wherein the geometrical diameter of the center conductor is less than the geometrical diameter of the first and the second conductors by approximately a factor of 4.

4. The apparatus as defined in claim 2, wherein the geometrical diameter of the center conductor is less than the geometrical diameter of the first and the second conductors by approximately a factor of 4.

5. The apparatus as defined in claim 1, wherein the center conductor for conducting the center current phase has a circular cross section.

6. The apparatus as defined in claim 3, wherein the center conductor for conducting the center current phase has a circular cross section.

7. The apparatus as defined in claim 1, wherein the first, second, and third mast arms have a rectangular cross section.

8. The apparatus as defined in claim 1, wherein the center conductor for conducting the center current phase is water cooled.

9. The apparatus as defined in claim 1, wherein the first and the second conductors for conducting the outer current phases are cooled with one of water, air and positive ventilation.

10. The apparatus as defined in claim 1, wherein the third mast arm is midway between the first and second mast arms.

11. An apparatus for transferring electrical energy from a furnace transformer to three electrodes of a three-phase arc furnace, the apparatus comprising:

a first mast arm, comprising a first conductor for conducting a first outer current phase;

a second mast arm, comprising a second conductor for conducting a second outer current phase; and a third mast arm located midway between the first and second mast arms and coplanar therewith, said first, second and third mast arms being made of a material having permeability coefficient approximately equal to hat of aluminum; and a center conductor contained within the third mast arm for conducting a center current phase, said center conductor comprising at least one high-current tube made of a material having good electrical conductivity that is mounted in an insulated fashion with respect to the third mast arm, said high-current tube having a smaller diameter than the largest circle that could be contained within either of the first or the second conductors.

12. The apparatus as defined in claim 11, wherein the diameter of the center conductor is less than the diameter of the largest diameter circle that could be contained within the first conductor by a factor of 4.

13. The apparatus as defined in claim 11, wherein the first and second mast arms have identical cross sections.

* * * * *

UNITED STATES PATENT AND TRADEMARK OFFICE

CERTIFICATE OF CORRECTION

PATENT No. : 5,889,811

DATED : March 30, 1999

INVENTOR(S): Christof Dratner

It is certified that error appears in the above-identified patent and that said Letters Patent is hereby corrected as shown below:

Column 4, line 32, after "having" insert –a–.

Signed and Sealed this

Twenty-fifth Day of April, 2000

*Attest:*

*Attesting Officer*

Q. TODD DICKINSON

*Director of Patents and Trademarks*